US005692387A

United States Patent [19]

Alsenz et al.

[11] Patent Number: 5,692,387

[45] Date of Patent: Dec. 2, 1997

[54] LIQUID COOLING OF DISCHARGE GAS

[75] Inventors: Richard H. Alsenz, Missouri City, Tex.; Timothy G. Burns, Hastings; Bryan J. Rees, Auckland, both of New Zealand

[73] Assignee: Altech Controls Corporation, Missouri City, Tex.

[21] Appl. No.: 430,637

[22] Filed: Apr. 28, 1995

[51] Int. Cl.[6] ..... E25B 1/00; E25B 5/00

[52] U.S. Cl. ..... 62/184; 62/498; 62/DIG. 2; 62/DIG. 17

[58] Field of Search ..... 62/DIG. 2, DIG. 17, 62/498, 117, 184

[56] References Cited

U.S. PATENT DOCUMENTS

| | | | |
|---|---|---|---|
| 1,946,328 | 2/1934 | Neff | 62/DIG. 2 X |
| 2,874,550 | 2/1959 | Musson | 62/DIG. 17 |
| 2,912,831 | 11/1959 | Palmatier | 62/DIG. 17 X |
| 3,134,241 | 5/1964 | Johnson | 62/DIG. 17 X |
| 3,368,364 | 2/1968 | Norton et al. | 62/DIG. 17 X |
| 4,599,873 | 7/1986 | Hyde | 62/498 |
| 5,115,644 | 5/1992 | Alsenz | 62/181 |
| 5,150,580 | 9/1992 | Hyde | 62/86 |
| 5,396,780 | 3/1995 | Bendtsen | 62/212 |
| 5,435,148 | 7/1995 | Sandofsky et al. | 62/DIG. 2 X |

OTHER PUBLICATIONS

Dossat, Roy J., *Principles of Refrigeration*, 3rd Ed., Prentice Hall Career & Technology, Englewood Cliffs, NJ (1991), pp. 1–552.

*Primary Examiner*—William E. Wayner

*Attorney, Agent, or Firm*—Conley, Rose & Tayon, PC; David A. Rose

[57] ABSTRACT

A refrigeration system includes in a closed loop connection a compressor for compressing a refrigerant, a desuperheater for cooling the hot compressor discharge gas via the injection of liquid refrigerant, and a condenser for condensing the compressed, desuperheated refrigerant into a liquid refrigerant. The liquid refrigerant is injected into the compressed refrigerant by utilizing a liquid column for supplying pressure to the liquid refrigerant for injecting liquid refrigerant into the compressed refrigerant without using a mechanical pump. Another method of injecting the liquid refrigerant into the compressed refrigerant is to use a venturi pump at the injection point to supply the liquid refrigerant for injection into the compressed refrigerant. The desuperheater causes the temperature of the hot refrigerant vapor leaving the compressor to be reduced from a superheated condition to temperature closer to its condensing temperature prior to its entry to the condenser. This results in lower condensing temperatures with consequent increases in capacity and system efficiency.

20 Claims, 8 Drawing Sheets

LIQUID COOLING OF DISCHARGE GAS

FIELD OF THE INVENTION

The present invention relates generally to a refrigeration system, and more particularly to an apparatus and method for improving the overall efficiency and refrigerating capacity of refrigeration systems by desuperheating the compressor discharge gas and making more effective use of the condensing surface to reduce the condensing temperature.

BACKGROUND OF THE INVENTION

Refrigeration condenser efficiency has been increased by boosting the airflow across the outside of the condenser and condenser fins, increasing the effective outside surface area, or increasing the effective inside surface area. Attempts to increase the effective inside surface area have generally involved increasing the effective wetting area by placing an inner sleeve inside the condenser tubing. The present invention increases the effective condensing surface by recirculating the liquid condensate into the condenser inlet.

U.S. Pat. No. 5,150,580 to Hyde discloses a related improvement in the structure and method of operation of refrigeration systems. The improvement of Hyde includes a centrifugal pump boosting the pressure of the liquid condensate, by a substantially constant increment of pressure, and conduit means connecting the pump outlet to the condenser inlet to cool the superheated refrigerant vapor entering the condenser thus reducing the condenser temperature and pressure. The present invention overcomes the deficiencies of the prior art.

SUMMARY OF THE INVENTION

The present invention provides for a refrigeration system which has in a closed loop, a compressor for compressing a refrigerant, a desuperheater for cooling the hot compressor discharge gas to substantially its condensing temperature by the recycle and injection of relatively cool refrigerant as a desuperheating liquid, and a condenser for condensing the compressed, desuperheated refrigerant into a liquid refrigerant. An electronic control system is also provided to control these functions of the refrigeration system.

The desuperheating liquid is liquid that has condensed in the condenser and is recycled back to an injection point upstream of the condenser inlet. The injection of this desuperheating liquid into the superheated refrigerant vapor leaving the compressor reduces the temperature of the refrigerant entering the condenser from its superheated condition to substantially its condensing temperature. This frees up heat transfer surface within the condenser for condensing and subcooling service, by desuperheating the vapor outside of the condenser. The desuperheating liquid accomplishes this temperature reduction more efficiently than the condenser, and allows additional condensing surface to be used for subcooling the condensed liquid.

Examples of the more important features of the invention have thus been summarized rather broadly in order that the detailed description thereof that follows may be better understood, and in order that the contributions to the art may be better appreciated. There are, of course, additional features of the invention that will be described hereinafter and which will form the subject of the claims appended thereto. These and various other characteristics and advantages of the present invention will be readily apparent to those skilled in the art upon reading the following detailed description of the preferred embodiments of the invention and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

For purposes of illustration and not by way of limitation, the present invention shall be described with respect to a refrigeration system and method wherein improved efficiency is obtained by compressing a refrigerant to a high pressure and temperature, desuperheating the hot compressor discharge gas with liquid refrigerant, and condensing the desuperheated refrigerant within a condenser.

The refrigeration system of the present invention includes a compressor, a condenser, an evaporator, a control system, and an injection system by which a liquid refrigerant is reinjected, at a desuperheating liquid injection point such as an injector, upstream of the condenser inlet, to substantially desuperheat the hot compressor discharge gas from the compressor before it reaches the condenser. Although the injection of subcooled liquid refrigerant is preferred, either condensed or subcooled liquid refrigerant may be recycled as desuperheating liquid without departing from the scope of the invention.

Desuperheating of the hot compressor discharge gas is accomplished by recycling liquid refrigerant. This liquid refrigerant may be obtained from various points in the refrigeration system, such as: the outlet of the condenser; the liquid line between the outlet of the condenser and the liquid receiver; or directly from the liquid receiver. The liquid refrigerant is passed through a refrigerant recycle line and back to the refrigerant line upstream of the inlet to the condenser.

Figure 1:
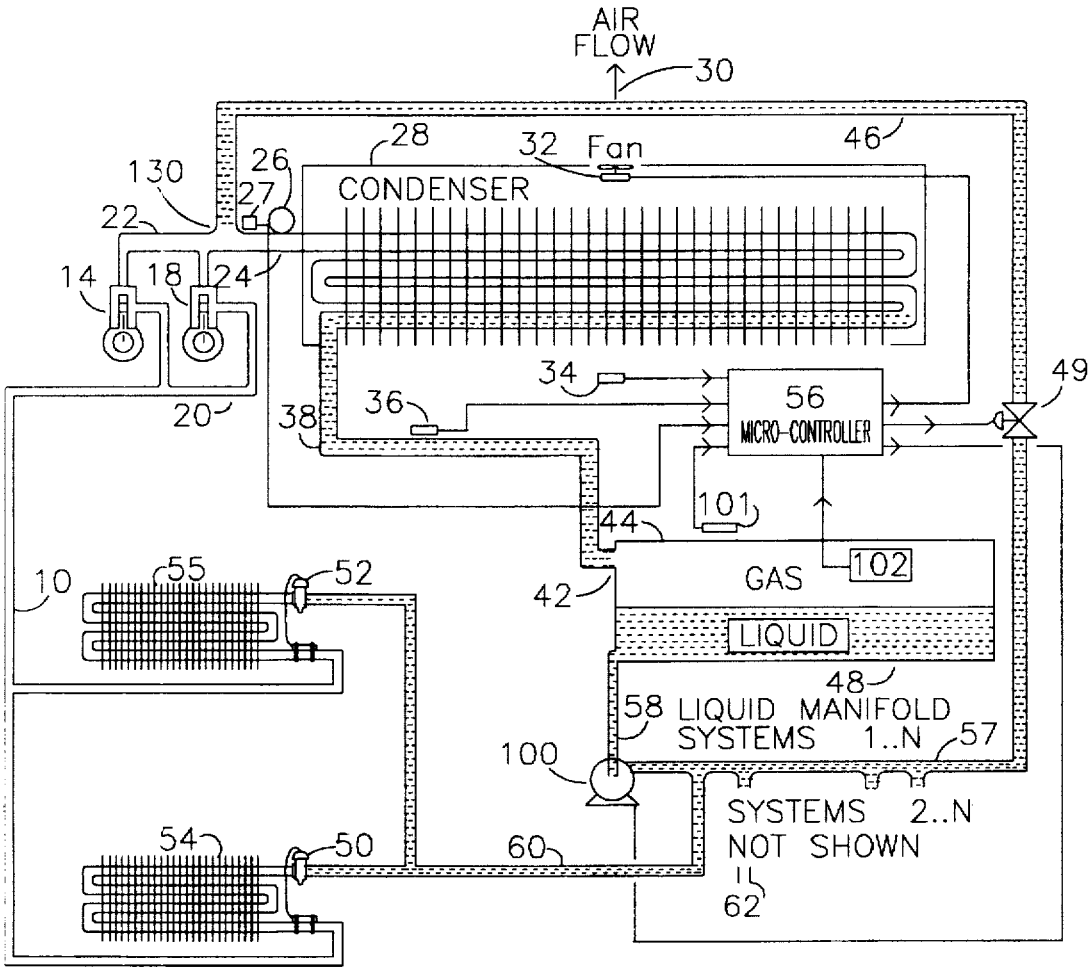
FIG. 1 depicts a refrigeration system embodying the invention which utilizes a secondary compressor to transport recycle liquid, for desuperheating, from a take-off point to an injection point such as an injector.

Referring initially to FIG. 1, one embodiment of the refrigeration system of the present invention is shown. The system includes at least one compressor, at least one condenser, at least one evaporator with an expansion device, at least one cooling fan, a reservoir for holding liquid refrigerant, temperature sensors at the condenser inlet and outlet to measure the temperature of the liquid refrigerant, and a recycle line to transport liquid refrigerant from a take-off point to a desuperheating liquid injection point. The refrigeration system may also contain a control valve disposed in the liquid recycle line to control the flow rate of recycle liquid for desuperheating.

The refrigeration system depicted in FIG. 1 is a closed loop, commonly connected, multiple-stage refrigeration system. A vapor refrigerant at a low pressure is passed into parallel compressors 14 and 18 via a refrigerant line 10. The compressors 14 and 18 compress the refrigerant to a high pressure gaseous state and discharge it through refrigerant lines 22 and 24 which communicate with a condenser 28. A temperature transducer 26 is installed in the refrigerant line 24, which provides an electrical signal to a microcontroller circuit 56, that is representative of the temperature of gas in line 24.

The microcontroller circuit 56 contains a microprocessor and other circuitry which enables it to receive signals from the various sensors used in the refrigerator system, to process these signals, and to control functions of the refrigeration system.

Still referring to FIG. 1, the condensed refrigerant leaves the condenser 28 through liquid line 38 as a liquid. A temperature sensor 36 is installed on liquid line 38 to measure the temperature of the liquid refrigerant and provide a corresponding signal to the microcontroller 56. Refrigerant is discharged from liquid line 38 through outlet 42 into a main fluid reservoir 44. Receiver 44 includes a temperature sensor 101, a pressure transducer (not shown), and a liquid level transducer 102 which provide input signals to microcontroller 56.

The liquid from the reservoir 44 flows through line 58 and through a liquid pump 100 into a liquid manifold system 57, where it enters a liquid line 60 that is connected to expansion valves 50 and 52. Each expansion valve 50 and 52 is connected to individual parallel evaporators 54 and 55 respectively. These evaporators form a single refrigeration system wherein the expansion valves 50 and 52 meter the liquid refrigerant into evaporators 54 and 55 respectively. Similarly, other refrigeration systems (not shown) may be connected to the liquid manifold system 57 via lines 62 and the like. When the liquid refrigerant is metered through the expansion valves 50 or 52, it evaporates into a gaseous state within its respective evaporator at a low pressure and a low temperature. The vapor refrigerant is passed to the compressors 14 and 18 through the suction line 10, which completes the refrigeration cycle that is continuously repeated during operation.

The present invention provides various means for injecting liquid refrigerant into refrigerant line 24. One such means is a member which pressurizes the liquid refrigerant at the injection point 130, which may be an injector. In the embodiment of FIG. 1, the pressurization member is a liquid pump 100 disposed between liquid line 58 and liquid recycle line 46. Since high compression ratios are not of benefit, liquid pump 100 may be a centrifugal type. The liquid pump 100, when in operation, ensures there is sufficient pressure in liquid recycle line 46 to transport recycle liquid refrigerant from the reservoir 44 to the desuperheating liquid injection point 130 disposed in refrigerant line 24 between the outlet of compressors 14, 18 and the inlet of condenser 28.

At the desuperheating liquid injection point 130, the recycle liquid refrigerant from recycle line 46 (the desuperheating liquid) is mixed with the hot compressor discharge gas in refrigerant line 24. The mixing of the subcooled recycle liquid refrigerant with the superheated discharge gas reduces the temperature of the discharge gas and decreases the extent to which the refrigerant entering the condenser is superheated above its condensing temperature. Decreasing the level of superheat in the vapor entering the condenser 28 reduces the desuperheating that must be done in the condenser 28, and thus reduces the condenser heat transfer surface needed to desuperheat the vapor and increases the condenser heat transfer surface area available for condensing and subcooling service. By increasing the subcooling taking place in the condenser 28, the operating temperature and pressure of the condenser 28 are reduced and thus the refrigeration system efficiency and refrigerating effect are increased.

In addition to the advantages of desuperheating, the present invention also maintains a higher pressure on the line 60, which further improves operation of the expansion valves 50 and 52. This also improves the flow of the liquid refrigerant from the condenser 28 to the reservoir 44.

Figure 2A:
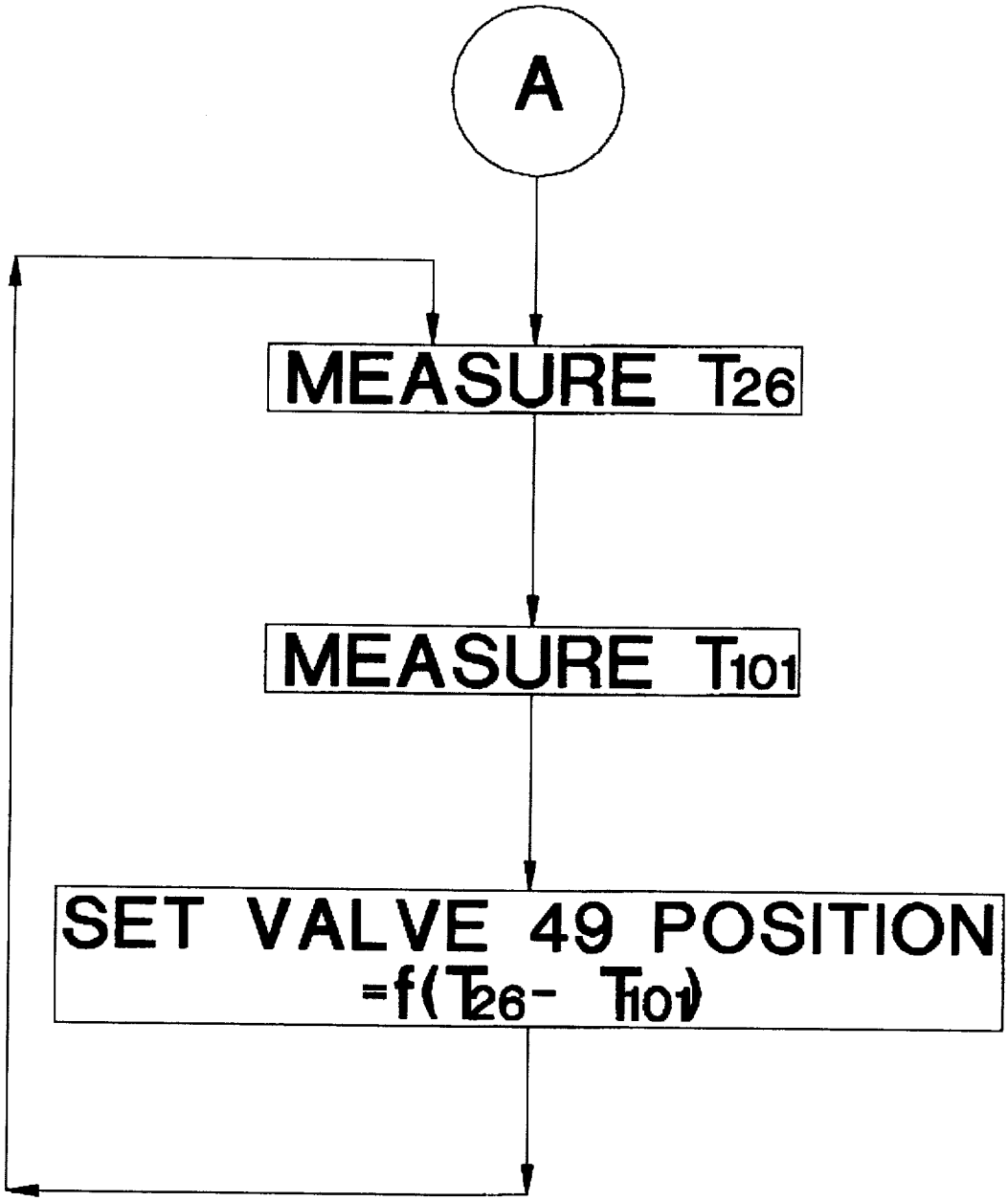
FIG. 2A–2C are logic flow diagrams illustrating a control method of the invention.

Preferably a control valve 49 is located in recycle line 46. As shown in the flow diagram of FIG. 2A, in this case microcontroller 56 may vary the flow of liquid refrigerant through line 46 by means of valve 49 as a function of the difference between the signals from temperature sensors 26 and 101 and consequently, vary the quantity of recycle liquid injected as desuperheating liquid. Pressure sensor 27 may also be located on refrigerant line 24 near temperature sensor 26. In this case microcontroller 56 may control the flow through line 46 as a function of the signals from temperature sensor 26 and/or pressure sensor 27 and thus may vary the resulting quantity of recycle liquid injected as desuperheating liquid. As will be obvious to one skilled in the art, many other control schemes may be used to control the flow rate of recycle liquid for desuperheating without departing from the present invention.

Desuperheating of the hot compressor discharge gas is thus accomplished by recycling liquid from a recycle liquid take-off point, such as the outlet of condenser 28, the liquid line 38 between the outlet of condenser 28 and the liquid receiver 44, or the receiver 44. The recycle liquid is passed through refrigerant line 58, liquid pump 100, refrigerant recycle line 46, and back to refrigerant line 24 upstream of the inlet to condenser 28 at desuperheating liquid injection point 130. As will be obvious to one skilled in the art, alternative methods of desuperheating the hot discharge gas using the condensate or subcooled liquid refrigerant can be employed without deviating from the scope of the present invention.

Figure 3:
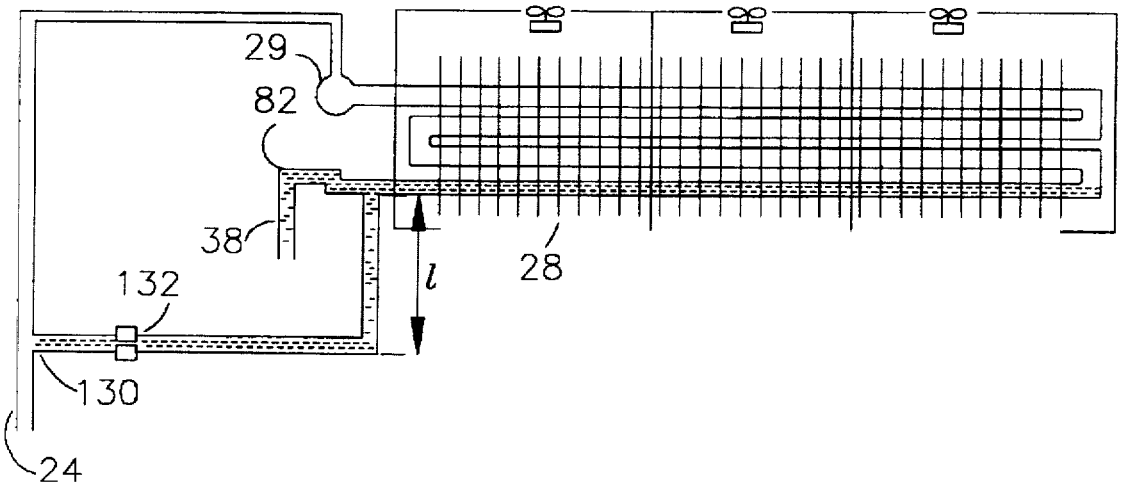
FIG. 3 shows other connections and an alternate take-off point from which recycle liquid for desuperheating may be drawn.
Figure 4:
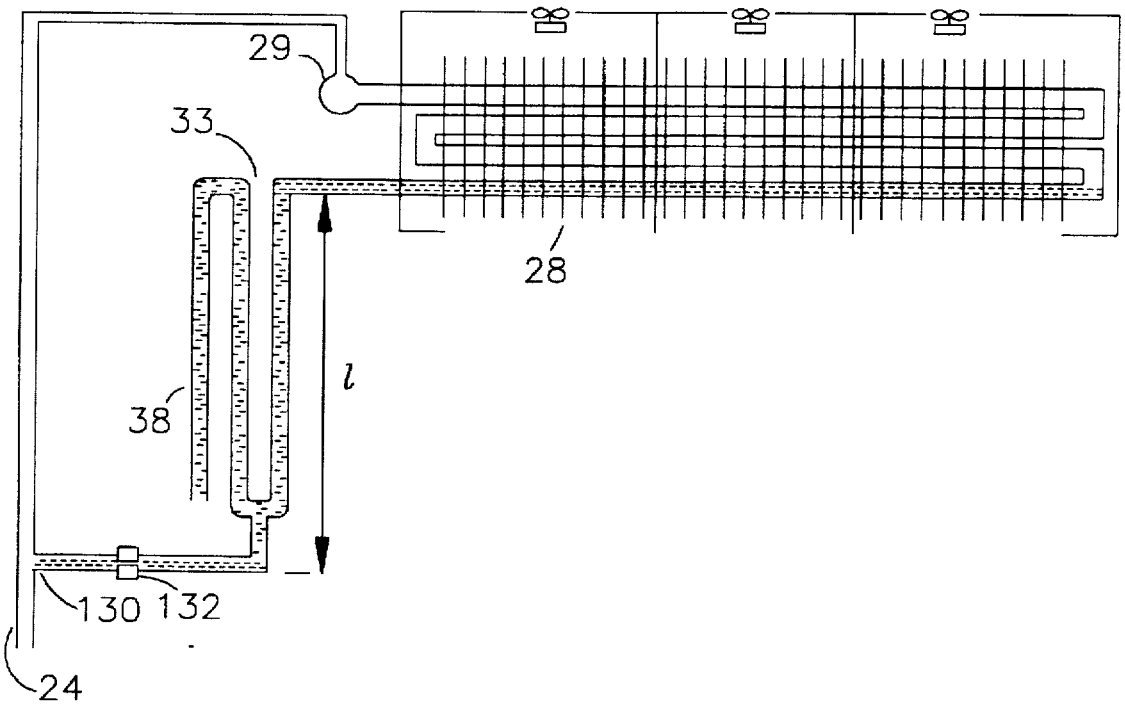
FIG. 4 shows additional connections and an additional alternate take-off point from which recycle liquid for desuperheating may be drawn.

Referring now to FIGS. 3 and 4, there is shown another preferred embodiment of the present invention in which the desuperheating liquid is taken at the outlet of the condenser 28. Liquid leaving the condenser may be maintained at a constant level by an inverted trap 82 shown in FIG. 3 or trap leg 83 shown in FIG. 4, which eliminate the need for the liquid pump shown in FIG. 1. A restriction 132 or control valve such as valve 49 may be placed adjacent the injection point 130 to assist in forming and controlling a liquid column in trap 82 or trap leg 83. The embodiment illustrated in FIGS. 3 and 4 provide a column of liquid refrigerant of sufficient height to overcome the pressure drop through condenser 28. This ensures that liquid refrigerant will flow, due to the weight of the liquid from condenser 28, to mix with the refrigerant vapor in line 24 at desuperheating liquid injection point 130.

Figure 5:
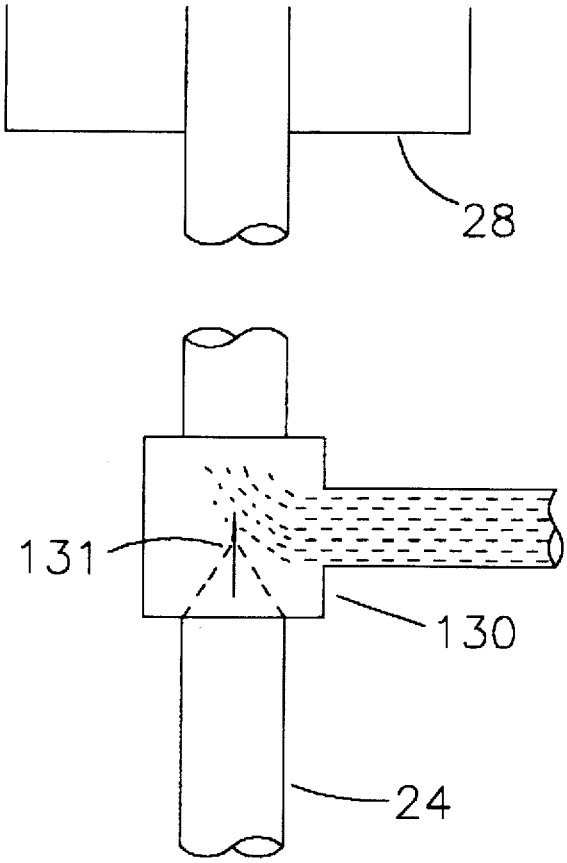
FIG. 5 shows schematically a configuration of a desuperheating liquid injection point, which is an injector.

In still another preferred embodiment, the desuperheating liquid injection point 130 may be configured as an injector, such as is shown schematically in FIG. 5. In this embodiment, the injector for injecting the desuperheating liquid into line 24 does not require a pressurization member. The liquid refrigerant is drawn into line 24 by a venturi effect. The refrigerant vapor in line 24 accelerates through orifice 131, facilitating its mixing with, and being cooled by, the liquid refrigerant entering injection point 130 from the condenser outlet. This assists in cooling the vapor prior to the mixture being introduced to the inlet of condenser 28. The orifice 131 could be combined with a pressurization member such as pump 100, trap 82 or trap leg 83.

In another embodiment, the present invention is also applicable in combination with enhanced subcooling of the refrigerant, such as is described in U.S. Pat. No. 5,115,664, which is incorporated herein by reference.

Figure 2B:
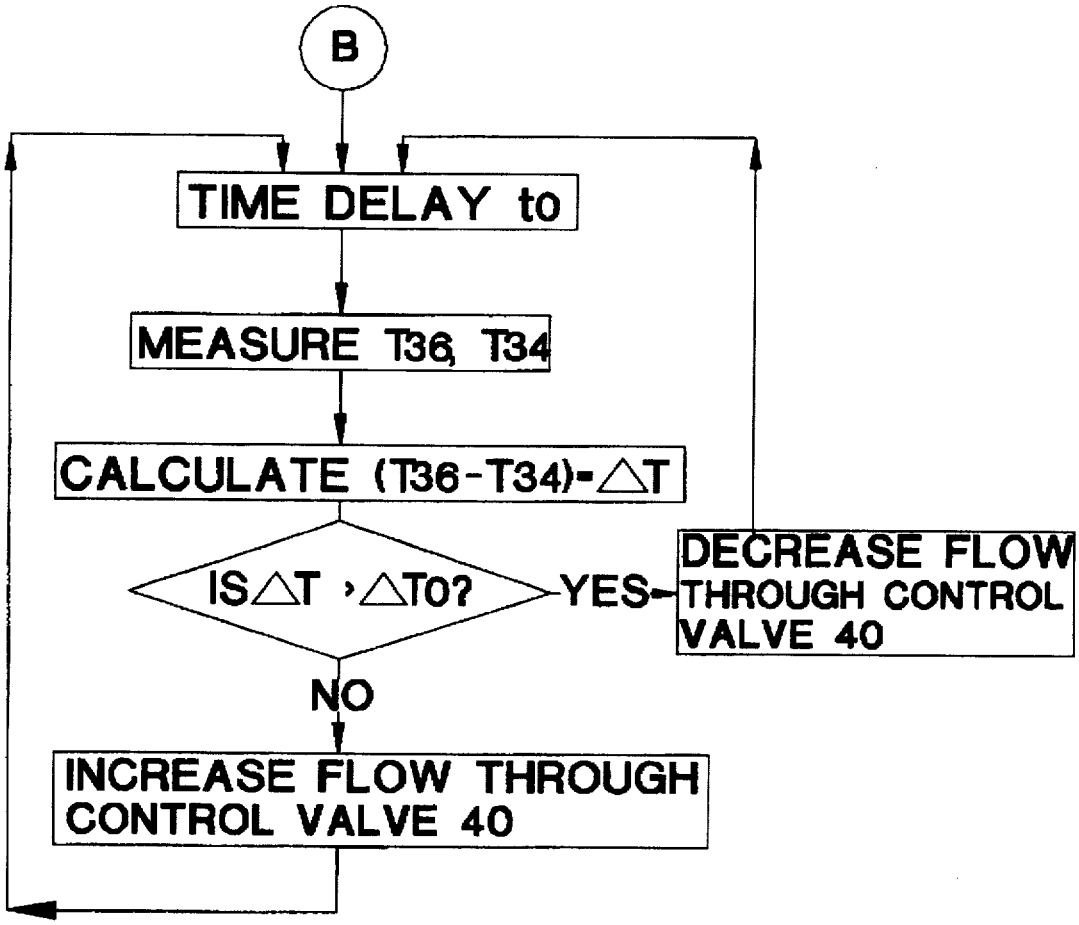
Figure 6:
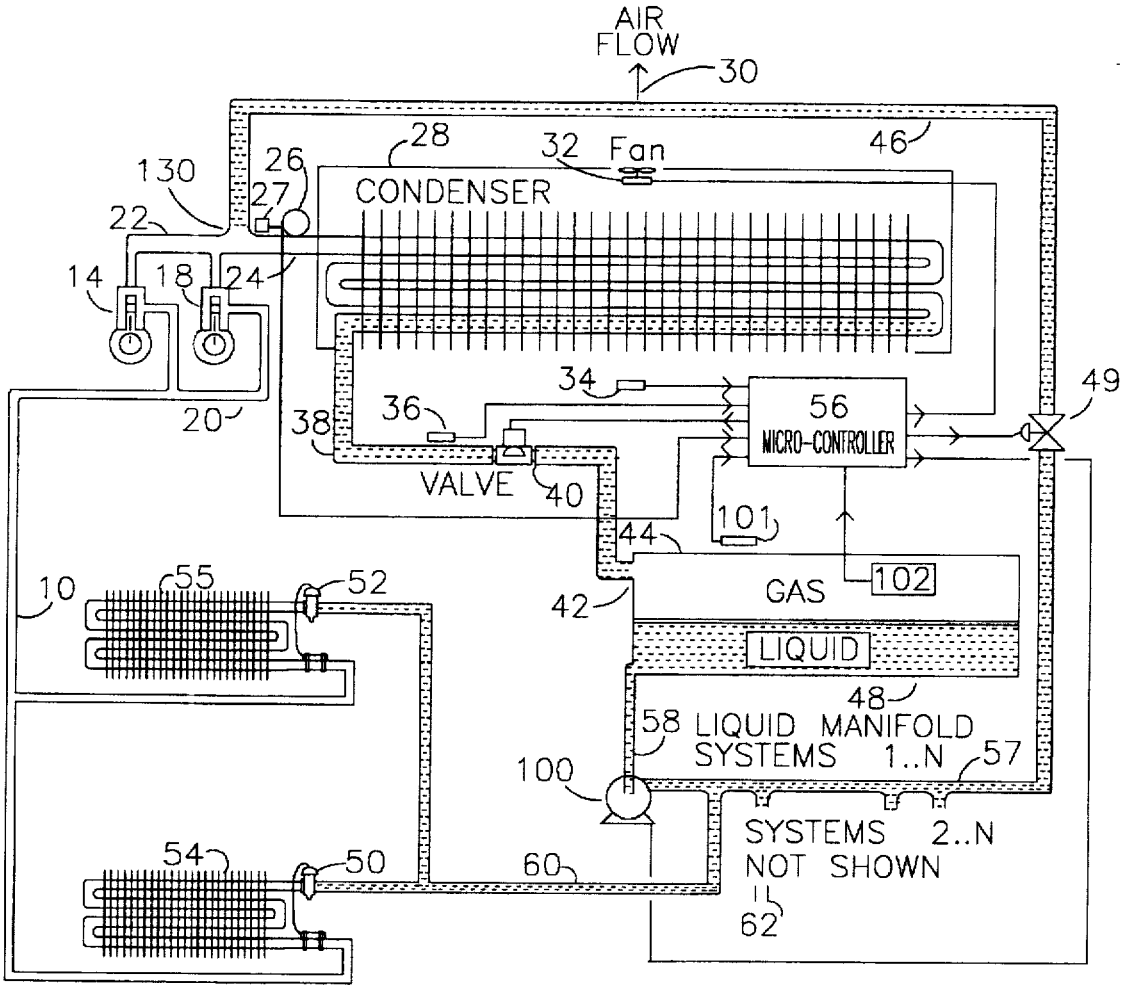
FIG. 6 depicts another embodiment of the refrigeration system of the present invention, further including a control valve in the liquid line.

Referring now to FIG. 6, still another embodiment of the refrigeration system of the present invention is shown which incorporates a control valve 40 disposed in liquid line 38 between condenser 28 and reservoir 44. As shown in the flow diagram of FIG. 2B, control valve 40 may be operated by microcontroller 56 to regulate the flow of liquid refrigerant from the condenser 28 to the reservoir 44. In this embodiment, the position of control valve 40 is used to control the temperature in the liquid line 38.

The control valve 40 prevents the flow of the entire liquid refrigerant from the condenser 28 to the reservoir 44 thereby enabling some of the liquid refrigerant to accumulate in the liquid line 38. The microcontroller 56 regulates the liquid refrigerant flow through the control valve 40 as a function of the difference between the liquid refrigerant temperature (ascertained by temperature sensor 36) and the ambient temperature (ascertained by temperature sensor 34) around condenser 28. When the temperature difference between the liquid refrigerant temperature and the ambient temperature ("ΔT") is greater than a predetermined value, the microcontroller 56 decreases the flow through the control valve 40. On the other hand, when the temperature difference ΔT is less than the predetermined value, the microcontroller 56 increases the flow through control valve 40. A time delay between successive decisions to alter the flow through the control valve 40 is programmed into the microcontroller 56 to smooth out the operation of the control valve 40.

The operation of the method described above ensures that during operation an amount of liquid refrigerant is maintained in the condenser 28 which is sufficient to provide subcooling of the liquid refrigerant before it is discharged into the reservoir 44. The liquid refrigerant flow through the control valve 40 may be controlled by either pulse modulating or analog modulating the flow control valve 40.

Figure 2C:
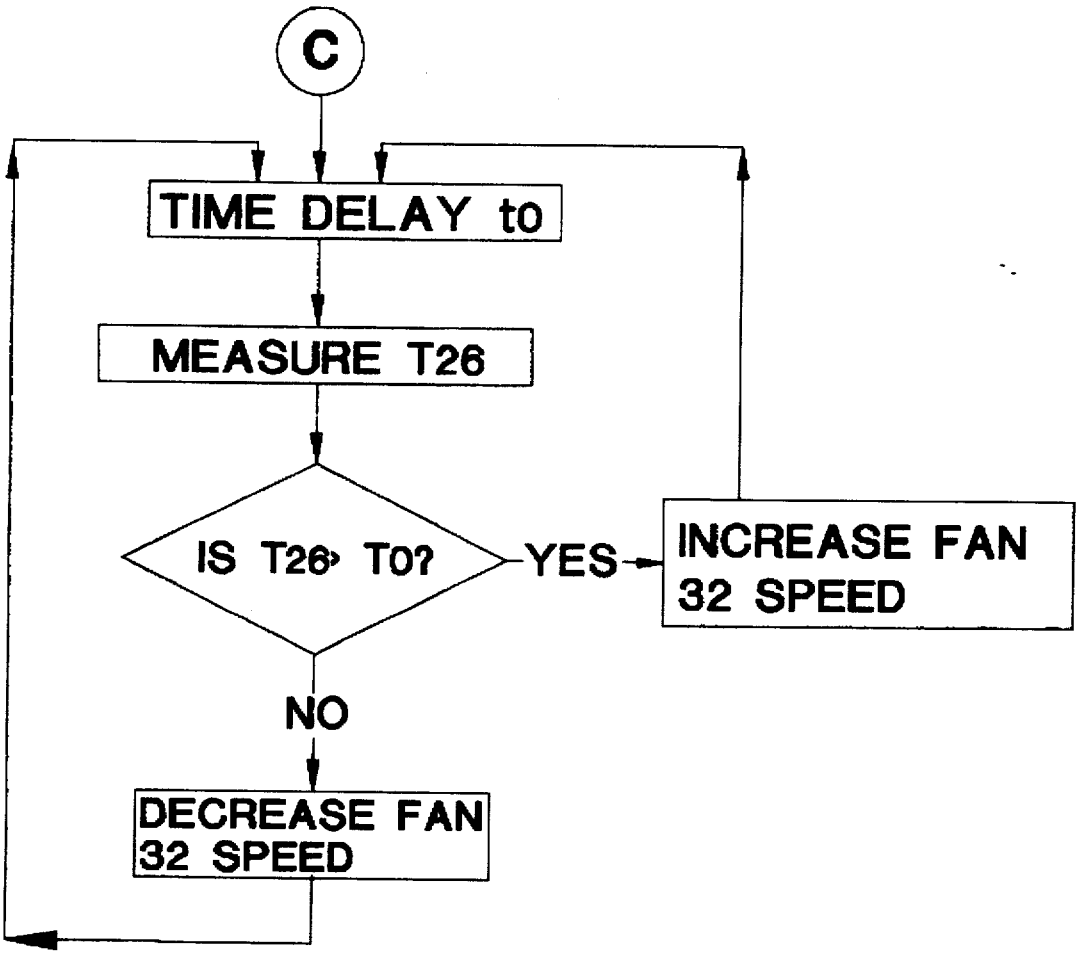

Further improvement in the overall system efficiency may be obtained by regulating the speed of fan 32 as a function of the discharge pressure of the gaseous refrigerant into the condenser. As shown in the flow diagram of FIG. 2C, the microcontroller 56 thus also controls or regulates the fan 32 to optimize the condensation of the gaseous refrigerant entering the condenser 28. When the temperature represented by the temperature transducer 26, i.e., the discharge pressure of the gaseous refrigerant entering into the condenser 28, is above a predetermined value, the microcontroller will increase the fan speed thereby causing it to increase air flow through the condenser 28. On the other hand, when the discharge temperature is below the predetermined value, the microcontroller 56 will decrease the speed of fan 32, thereby decreasing the air flow through the condenser 28. Also, a time delay between successive speed controls is provided to avoid changing the fan speed too frequently.

While the invention has been described in accordance with air cooled condensers, one skilled in the art may easily apply the invention to water or fluid cooled condensers of all sorts. It is intended that the current invention shall apply to all types of condensers. All types of condensers have not been specifically described because they are considered redundant in application of the invention in view of the above description.

Further, the present invention is equally applicable to condenser systems employing modulation of multiple condenser cooling fans or water flow modulation in the case of water cooled condensers. As would be obvious to one skilled in the art, many other applications of the present invention are possible without departing from the spirit of the invention and the description provided herein is intended to be limited only by the claims appended hereto.

We claim:

1. A closed refrigeration system with subcooled liquid supplied to a condenser inlet from a condenser outlet and elevated to a higher pressure by a liquid column, sufficient to discharge the subcooled liquid at an injection point upstream of the condenser inlet.

2. A closed refrigeration system with subcooled liquid supplied from a condenser outlet and elevated to a higher pressure by a liquid column, sufficient to discharge the subcooled liquid at an injection point upstream of the condenser inlet wherein the subcooled liquid is injected into a compressed gas discharge line connecting a compressor outlet to the condenser inlet.

3. The apparatus of claim 2 further comprising:

a trap leg in which the liquid column is created, said trap leg being substantially U-shaped; and a flow restricting orifice upstream of the injection point for maintaining the level of the liquid column.

4. A refrigeration system, comprising:

a compressor for compressing a refrigerant;

a condenser for condensing the compressed refrigerant into a liquid refrigerant, subcooling the liquid refrigerant, and discharging the subcooled refrigerant through a condenser outlet, said condenser disposed in closed loop connection with said compressor;

a liquid column for raising the pressure of the subcooled liquid refrigerant, said liquid column raising the pressure of the subcooled liquid refrigerant to a level sufficient to discharge it through an injector;

said injector injecting the subcooled liquid refrigerant into the compressed refrigerant to mix with anal desuperheat the compressed refrigerant;

said injector further discharging the mixed refrigerants to the condenser.

5. The apparatus of claim 4 further comprising a flow restricting orifice for maintaining the level Of subcooled liquid refrigerant in the liquid column.

6. A refrigeration system comprising:

a compressor for compressing a refrigerant;

a condenser for condensing the compressed refrigerant into a liquid refrigerant and subcooling the liquid refrigerant, said condenser disposed in closed loop connection with said compressor;

a conduit member connecting an outlet of the compressor to an inlet to the condenser, said conduit member receiving the compressed refrigerant;

an injector disposed in said conduit member for receiving subcooled liquid refrigerant and mixing the subcooled liquid refrigerant with the compressed refrigerant;

said injector receiving the subcooled liquid refrigerant at a pressure substantially the same as the pressure of the liquid refrigerant at an outlet of the condenser and discharging the subcooled liquid refrigerant at a pressure greater than that at the condenser inlet;

said compressed refrigerant being substantially desuperheated within the conduit member;

said conduit member discharging all the subcooled liquid refrigerant and desuperheated compressed refrigerant as a mixed refrigerant stream to the condenser inlet.

7. The refrigeration system of claim 6 further comprising:

an electrically operable control valve disposed at the condenser outlet for controlling the flow of liquid refrigerant discharged from the condenser;

a variable speed fan for providing airflow over the condenser;

a first temperature sensor near the outlet of the condenser providing an electrical signal that is representative of the temperature of the liquid refrigerant near the condenser outlet;

a second temperature sensor adjacent to the condenser for providing an electrical signal that is representative of the ambient temperature around said condenser;

a control circuit electrically connected to the temperature sensors, fan, and control valve, said control circuit controlling refrigerant flow through the control valve as a function of the difference between the ambient temperature and the temperature of the liquid refrigerant, and controlling the fan speed to regulate the airflow around the condenser to enable the subcooling of the liquid refrigerant prior to discharge of the liquid refrigerant from the condenser.

8. A refrigeration system, comprising:

a compressor for compressing a vapor refrigerant into a compressed refrigerant;

a condenser for condensing the compressed refrigerant into a liquid refrigerant and subcooling the liquid refrigerant;

evaporator for evaporating the liquid refrigerant into a vapor refrigerant;

a compressed refrigerant line extending from said compressor to said condenser;

a liquid refrigerant line extending from said condenser to said evaporator;

a vapor refrigerant line extending from said evaporator to said compressor;

a recycle line extending from said liquid refrigerant line to said compressed refrigerant line for desuperheating the compressed refrigerant;

a first control valve disposed in said recycle line for controlling the flow of the liquid refrigerant to said compressed refrigerant line;

a second control valve at the condenser outlet for controlling the discharge of liquid refrigerant from the condenser;

a control circuit electrically connected to said control valve for controllably operating said second control valve to subcooled the liquid refrigerant in the condenser, and for controllably operating said first control valve to desuperheat the compressed refrigerant.

9. The apparatus of claim 8 further including a reservoir in said liquid refrigerant line for supplying liquid refrigerant to said recycle line.

10. The apparatus of claim 9 further including:

a first temperature sensor disposed in said compressed refrigerant line to produce an electrical signal proportional to the compressed refrigerant temperature upstream of the condenser;

a second temperature sensor disposed at said compressed refrigerant line to produce an electrical signal proportional to the temperature of the refrigerant at said reservoir;

said control circuit in electrical connection with said temperature sensors and said control valves to control the flow of the subcooled liquid refrigerant through the recycle line to reduce the temperature of the compressed refrigerant to substantially the condensing temperature of the compressed refrigerant.

11. The apparatus of claim 10 further comprising:

a third temperature sensor disposed at the condenser outlet to produce an electrical signal proportional to the temperature of the liquid refrigerant near the condenser outlet;

a fourth temperature sensor disposed adjacent to the condenser to provide an electrical signal proportional to the ambient temperature around the condenser;

said control circuit also in electrical connection with said third and fourth temperature sensors and controlling the second control valve to subcooled the liquid refrigerant discharged from the condenser.

12. The apparatus of claim 11 wherein said control circuit comprises a microprocessor.

13. A refrigeration system, comprising:

a compressor for compressing a vapor refrigerant into a compressed refrigerant;

a condenser for condensing the compressed refrigerant into a liquid refrigerant;

an evaporator for evaporating the liquid refrigerant into a vapor refrigerant;

a compressed refrigerant line extending from said compressor to said condenser;

a liquid refrigerant line extending from said condenser to said evaporator;

a vapor refrigerant line extending from said evaporator to said compressor;

a recycle line extending from said liquid refrigerant line to said compressed refrigerant line for desuperheating the compressed refrigerant;

a first electrically operable control valve disposed in said recycle line for controlling the flow of the liquid refrigerant to said compressed refrigerant line;

a reservoir in said liquid refrigerant line for supplying liquid refrigerant to said recycle line;

a second electrically operable control valve disposed in said liquid refrigerant line prior to said reservoir for controlling the liquid refrigerant as it passes from said condenser into said reservoir;

a variable speed fan for providing airflow over said condenser;

a first temperature sensor at said liquid refrigerant line for providing an electrical signal that is representative of the temperature of the liquid refrigerant near said condenser;

a second temperature sensor adjacent said condenser for providing an electrical signal that is representative of the ambient temperature around said condenser;

a control circuit electrically connected to said temperature sensors, fan, and control valves said control circuit controllably operating said first control valve, and controlling refrigerant flow through said second control valve as a function of the temperature difference between the ambient temperature and the temperature of the liquid refrigerant, and controlling the fan speed to regulate the airflow around the condenser to enable the subcooling of the liquid refrigerant prior to passage into said reservoir.

14. A refrigeration system, comprising:

a compressor for compressing a vapor refrigerant into a compressed refrigerant;

a condenser for condensing the compressed refrigerant into a liquid refrigerant;

an evaporator for evaporating the liquid refrigerant into a, vapor refrigerant;

compressed refrigerant line extending from said compressor to said condenser;

a liquid refrigerant line extending from said condenser to said evaporator;

a vapor refrigerant line extending from said evaporator to said compressor;

a recycle line extending from said liquid refrigerant line to said compressed refrigerant line for desuperheating the compressed refrigerant;

a first electrically operable control valve disposed in said recycle line for controlling the flow of the liquid refrigerant to said compressed refrigerant line;

a control circuit electrically connected to said first control valve for controllably operating said control valve;

a liquid reservoir for receiving condensed liquid refrigerant from said condenser;

a second electrically operable control valve at said condenser outlet for controlling the flow of liquid refrigerant from said condenser into said reservoir;

a variable speed fan for providing airflow over said condenser;

a first temperature sensor for providing an electrical signal that is representative of the temperature of the liquid refrigerant at said condenser outlet;

a second temperature sensor adjacent said condenser for providing an electrical signal that is representative of the ambient temperature around said condenser;

a microcontroller, electrically connected to said temperature sensors, fan, and said second control valve, and controlling the flow of liquid refrigerant through said second control valve as a function of the temperature difference between the ambient temperature and the temperature of the liquid refrigerant at said condenser outlet, and controlling the speed of said fan to regulate the airflow around said condenser so as to subcooled the liquid refrigerant prior to flowing into said reservoir.

15. A method of increasing the condensing surface of a condenser comprising the steps of:

measuring certain parameters of the compressed refrigerant passing into the condenser;

injecting liquid refrigerant into the compressed refrigerant passing into the condenser;

controlling the rate of flow of the liquid refrigerant into the compressed refrigerant as a function of the certain parameters of the compressed refrigerant; and increasing the condensing surface by reducing the amount of condenser surface required to desuperheat the compressed refrigerant passing into the condenser controlling that rate of flow of liquid refrigerant discharging from the condenser to subcooled the liquid refrigerant prior to injecting the liquid refrigerant into the compressed refrigerant.

16. The method of claim 15 further including the step of controlling the flow of ambient air across the condenser to cause the liquid refrigerant discharged from the condenser to be subcooled.

17. Apparatus for desuperheating a hot compressed refrigerant vapor, comprising:

a compressor outlet for discharging the hot compressed refrigerant vapor;

a condenser for condensing the refrigerant vapor to a liquid refrigerant, and having a condenser inlet and a condenser outlet;

a first conduit member connecting the compressor outlet to the condenser inlet;

an injector disposed in the first conduit member;

a second conduit member connecting the condenser outlet to the injector;

a column of liquid refrigerant within the second conduit member and disposed at a sufficiently high elevation relative to the injector that the liquid refrigerant will flow through the second conduit member from the condenser outlet to the injector under the influence of gravity.

18. The apparatus of claim 17, further comprising:

a valve disposed in the second conduit member to regulate the flow of liquid refrigerant to the injector.

19. The apparatus of claim 18, further comprising:

a sensor disposed in the first conduit member to provide a signal representative of the refrigerant temperature in the first conduit member;

a control circuit electrically connected to the sensor and the control valve and controlling the position of the control valve as a function of the sensor signal.

20. The apparatus of claim 19, wherein the sensor provides a signal representative of the refrigerant pressure in the first conduit member.

* * * * *